US008126388B2

(12) United States Patent
Lofthus et al.

(10) Patent No.: US 8,126,388 B2
(45) Date of Patent: Feb. 28, 2012

(54) FACE-TO-FACE PRINTING WITHIN BOOKLET

(75) Inventors: Robert M. Lofthus, Webster, NY (US); Thomas M. Baretsky, Fairport, NY (US); Dusan Lysy, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 190 days.

(21) Appl. No.: 12/540,546

(22) Filed: Aug. 13, 2009

(65) Prior Publication Data

US 2009/0311019 A1 Dec. 17, 2009

Related U.S. Application Data

(60) Division of application No. 11/926,973, filed on Oct. 29, 2007, now Pat. No. 7,591,603, which is a continuation of application No. 10/948,509, filed on Sep. 23, 2004, now abandoned, which is a division of application No. 10/382,615, filed on Mar. 5, 2003, now Pat. No. 6,814,004.

(51) Int. Cl.
*G03G 15/00* (2006.01)

(52) U.S. Cl. ..... 399/401; 399/405; 271/291

(58) Field of Classification Search ..... 399/401, 399/405; 271/186, 291
See application file for complete search history.

(56) References Cited

U.S. PATENT DOCUMENTS

| | | | | |
|---|---|---|---|---|
| 3,987,722 | A | | 10/1976 | Goodwin |
| 4,116,558 | A | | 9/1978 | Adamek et al. |
| 4,334,765 | A | | 6/1982 | Clark |
| 4,384,782 | A | * | 5/1983 | Acquaviva ..... 399/373 |
| 4,493,482 | A | | 1/1985 | Valenti et al. |
| 4,579,446 | A | | 4/1986 | Fujino et al. |
| 4,814,822 | A | | 3/1989 | Acquaviva et al. |
| 4,815,225 | A | | 3/1989 | Wilen |
| 5,095,342 | A | | 3/1992 | Farrell et al. |
| 5,105,283 | A | | 4/1992 | Forest et al. |
| 5,142,340 | A | | 8/1992 | Farrell et al. |
| 5,159,395 | A | | 10/1992 | Farrell et al. |
| 5,337,135 | A | | 8/1994 | Malachowski et al. |
| 5,377,965 | A | | 1/1995 | Mandel et al. |
| 5,557,367 | A | | 9/1996 | Yang et al. |
| 5,568,246 | A | | 10/1996 | Keller et al. |
| 5,670,995 | A | | 9/1997 | Kupcho et al. |
| 5,760,919 | A | | 6/1998 | Acquaviva et al. |
| 5,839,044 | A | * | 11/1998 | Taruki ..... 399/361 |
| 5,839,045 | A | | 11/1998 | Wierszewski |
| 5,848,345 | A | | 12/1998 | Stemmle |
| 5,930,577 | A | | 7/1999 | Forsthoefel et al. |
| 6,099,225 | A | | 8/2000 | Allen et al. |
| 6,269,237 | B1 | | 7/2001 | Olbrich et al. |
| 6,286,831 | B1 | | 9/2001 | Marasco et al. |
| 6,317,581 | B1 | | 11/2001 | Boehmer et al. |
| 6,397,023 | B1 | | 5/2002 | Underwood et al. |
| 6,478,490 | B2 | * | 11/2002 | Kelley et al. ..... 400/624 |
| 6,550,762 | B2 | | 4/2003 | Stoll |
| 6,681,085 | B1 | | 1/2004 | Collard et al. |
| 2008/0089710 | A1 | | 4/2008 | Lofthus et al. |

* cited by examiner

*Primary Examiner* — Ren Yan
(74) *Attorney, Agent, or Firm* — Fay Sharpe LLP

(57) ABSTRACT

Method for printing pages within a booklet to improve the appearance of images on opposing pages includes sequencing images such that opposing pages are printed with the same print engine and/or fused the same number of times. Booklets include opposing pages having images fused the same number of times and/or printed with the same print engine as the image on the opposing page.

12 Claims, 4 Drawing Sheets

FACE-TO-FACE PRINTING WITHIN BOOKLET

CROSS-REFERENCE TO RELATED APPLICATIONS

This is a divisional of U.S. application Ser. No. 11/926,973, filed Oct. 29, 2007, which is a continuation of U.S. application Ser. No. 10/948,509 filed Sep. 23, 2004, which is a divisional of U.S. application Ser. No. 10/382,615 filed Mar. 5, 2003, now U.S. Pat. No. 6,814,004 by the same inventors, and claims priority therefrom, all of which are hereby incorporated by reference in their entireties.

BACKGROUND AND SUMMARY

This invention relates generally to producing improved printing of face-to-face pages within a booklet and, more specifically, to a method for printing pages within a booklet to improve face-to-face appearance and the booklet produced thereby.

Customer acceptance of booklets assembled from duplex pages is sensitive to the consistency of appearance of opposing pages. Differences in color gamut, gloss, image size, and clarity are some of the problems encountered. Problems relating to cluster printing, that is, jobs assembled from separate machines include sheets with different gloss, color gamut, and image quality characteristics.

Tandem immediate duplex (xerographic) printers provide normal ordering of front sides on a first photoreceptor and back sides on a second photoreceptor, which also leads to similar problems. One example of such an apparatus is a tandem immediate duplex (color) xerographic (continuous) web printer. Another example is a tandem immediate duplex xerographic (cut sheet) printer, wherein images destined for the front sides of the physical sheets, i.e., the odd numbered pages, are imaged and developed sequentially on a first photoreceptor and images destined for the back sides of the physical sheets, i.e., the even numbered pages, are imaged and developed sequentially on a second photoreceptor. The physical sheets are fused twice; the first time in fuser #1 after transfer of the image on the front side of the sheet and the second time in fuser #2 after transfer of the image onto the back side of the sheet. Images on opposing pages have a different fused state and have been imaged/developed on different photoreceptor units. For example, an odd numbered page having an image developed on photoreceptor #1 that has been fused twice is opposed by an even numbered page having an image developed on photoreceptor #2 that has been fused only once.

Recirculating duplex printers having fusers present only the more subtle problem of differing fused state of opposing pages. This can lead to different gloss, different image shrinkage and/or misregistration of images. For example, a xerographic printer having a recirculating duplex paper path typically uses a fuser to fuse the image(s) to the paper. Images destined for the front sides of the physical sheets, i.e., the odd numbered pages, are imaged sequentially. After transfer of the first side image the physical page is inverted and recirculated. Images destined for the back sides of the physical sheets, i.e., the even numbered pages, are imaged sequentially. After transfer of the image destined for the back side, each physical page passes through the fuser again, bypasses the inverter and is stacked. The images on opposing pages in the stacker destined for a booklet have been fused a different number of times. For example, the image on page 14 has been fused once while the image opposing it, on page 15, has been fused twice.

A method in accordance with one embodiment includes producing a booklet from a multiple engine serial duplex printer, by:

- ordering sequentially a first plurality of images on a first printing device;
- feeding sequentially a plurality of two-sided sheets to the first printing device;
- printing sequentially on one side of each of the plurality of two-sided sheets a corresponding one of the first plurality of images;
- ordering sequentially a second plurality of images on a second printing device, such that when the second plurality of images is sequentially printed on a corresponding one of the other side of each of the plurality of two-sided sheets and alternate sheets in the sequence are inverted and stacked with alternate non-inverted sheets, images on opposing sides of the sheets are printed by the same printing device;
- feeding sequentially the plurality of two-sided sheets to the second printing device;
- printing sequentially on the other side of each of the plurality of two-sided sheets a corresponding one of the second plurality of images;
- inverting alternated ones of the plurality of two-sided imaged sheets; and
- stacking sequentially the inverted sheets and non-inverted sheets, so that images on opposing sides of the sheets are printed by the same printing device.

A method in accordance with another embodiment includes producing a booklet from a multiple engine serial duplex printer, by:

- ordering sequentially a first plurality of images on a first printing device;
- feeding sequentially a plurality of two-sided sheets to the first printing device;
- transferring sequentially on one side of each of the plurality of two-sided sheets a corresponding one of the first plurality of images;
- fixing the image marked on each sheet;
- ordering sequentially a second plurality of images on a second printing device, such that when the second plurality of images is sequentially fixed to a corresponding one of the other side of each of the plurality of two-sided sheets and alternate sheets in the sequence are inverted and stacked with alternate non-inverted sheets, images on opposing sides of the sheets are subject to the fixing process the same number of times and are printed by the same printing device;
- feeding sequentially the plurality of two-sided sheets to the second printing device;
- transferring sequentially on the other side of each of the plurality of two-sided sheets a corresponding one of the second plurality of images;
- fixing the images marked on each sheet, the images corresponding to the first plurality images being fixed a second time and the images corresponding to the second plurality images being fixed a first time;
- inverting alternated ones of the plurality of two-sided printed sheets; and
- stacking sequentially the inverted sheets and non-inverted sheets, so that images on opposing sides of the sheets are subject to the fixing process the same number of times and are printed by the same printing device.

A method in accordance with another embodiment includes producing a booklet from a recirculating duplex printer, by:

ordering sequentially a first plurality of images on a printing device;

feeding sequentially a plurality of two-sided sheets to the printing device;

transferring sequentially on one side of each of the plurality of two-sided sheets a corresponding one of the first plurality of images;

fixing the image marked on each sheet;

inverting sequentially a first pass of each one of the imaged plurality of two-sided sheets;

ordering sequentially a second plurality of images on the printing device, such that when the second plurality of images is sequentially fixed to a corresponding one of the other side of each of the plurality of two-sided sheets and alternate sheets on the second pass in the sequence are inverted and stacked with the alternate second pass non-inverted sheets, images on opposing sides of the sheets are subject to the fixing process the same number of times;

feeding sequentially the plurality of two-sided sheets to the printing device;

transferring sequentially on the other side of each of the plurality of two-sided sheets a corresponding one of the second plurality of images;

fixing the images marked on each sheet, the images corresponding to the first plurality images being fixed a second time and the images corresponding to the second plurality images being fixed a first time;

inverting alternate ones on the second pass of the plurality of two-sided printed sheets; and stacking sequentially the inverted sheets on the second pass and the non-inverted sheets on the second pass, so that images on opposing sides of the sheets have been subject to the fixing process the same number of times.

Another embodiment includes a booklet including a plurality of pages each having an image contained thereon wherein each image has been subject to a fixing process the same number of times as the image on an opposing page and wherein each image has been printed by the same printing device as the image on an opposing page.

Another embodiment includes a booklet including a plurality of pages each having an image printed thereon by a multiple engine serial duplex printer, wherein each image has been printed by the same printing device as the image on an opposing page.

DETAILED DESCRIPTION

Figure 1:
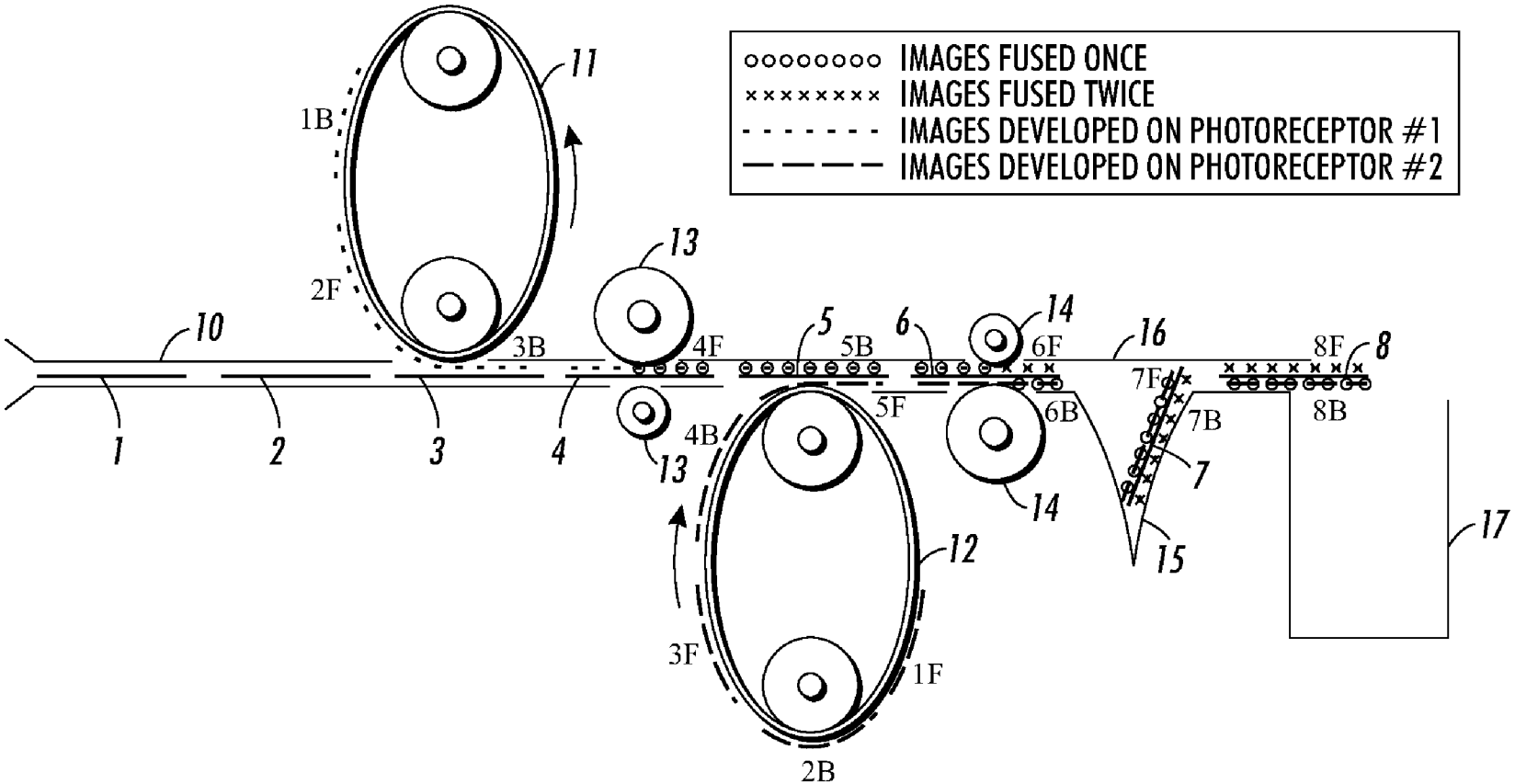
FIG. 1 is a schematic view of the paper path in a tandem duplex printer at an early moment in accordance with one embodiment.

The terminology "copiers", "copies", "printers", "prints", "imaging", "marking", and "printing" is used alternatively herein and refers to the entire process of putting an image (digital or analog source) onto paper. The image can be permanently fixed to the paper by fusing, drying, or other methods. It will be appreciated that the invention may apply to almost any system in which the images are made electronically, including electronic copiers.

Imaging systems (e.g., printers or copiers) typically include copy sheet paper paths through which copy sheets (e.g., plain paper) which are to receive an image are conveyed and imaged. The process of inserting copy sheets into the copy sheet paper path and controlling the movement of the copy sheets through the paper path to receive an image on one or both sides, is referred to as "scheduling". Copy sheets are printed by being passed through a copy sheet paper path (which includes a marking station) one or multiple times. Copy sheets which are printed on only one side (simplex copy sheets) in a single color usually pass through the copy sheet paper path a single time. Multipass printing is used to print images on both sides of a copy sheet (duplex printing), or to print a simplex sheet in multiple colors (one pass for each color). There are two general modes in which copy sheets to be multipass printed can be scheduled: "burst mode" and "interleave mode".

When scheduling in "burst mode", copy sheets are inserted into, imaged, and output from the copy sheet paper path without any "skipped pitches" existing between each consecutive copy sheet. A "pitch" is the portion (or length) of the copy sheet paper path in the process direction which is occupied by a copy sheet as it moves through the copy sheet paper path. A "skipped pitch" occurs when there is a space between two consecutively output copy sheets which is long enough to hold another copy sheet. Accordingly, when scheduling in "burst mode", copy sheets are output from the copy sheet paper path (and, thus, the imaging system) at a maximum rate because no skipped pitches exist between each consecutive copy sheet.

When scheduling copy sheets in "interleave mode", skipped pitches are provided between each consecutively scheduled copy sheet. That is, a space is provided between each copy sheet inserted into and output from the copy sheet paper path. While other copy sheets may be eventually inserted in the space between two consecutively input sheets, these other sheets are inserted at a later time and are thus "interleaved" with the previously inserted copy sheets.

Various methods for scheduling copy sheets are disclosed in, for example, U.S. Pat. Nos. 5,095,342; 5,159,395; and 5,557,367, which are incorporated herein by reference in their entirety.

This invention in embodiments thereof relates to a method for printing pages within a booklet to improve the appearance of images on opposing pages. In one embodiment this includes sequencing images such that opposing images are printed with the same print engine. In another embodiment, this includes sequencing images such that opposing images are fused the same number of times for uniformity of paper shrinkage and image characteristics. In accordance with the present invention, images can be fixed by fusing or any other method known to one skilled in the art. In yet another embodiment, this includes a combination of the above.

In one embodiment, a schematic of the photoreceptors, fusers, paper path including inverter/bypass, and stacker of a tandem immediate duplex printer is shown in FIG. 1 for a 16 page (8 sheet) booklet job. Other types of duplex printers known in the art are suitable for use in accordance with the invention. Either a cut sheet or continuous web type can be utilized. The sheets are scheduled to provide a booklet having opposing pages fused the same number of times and developed on the same photoreceptor. The print images are ordered so that opposing faces of pages in the finished booklet are printed by the same photoreceptor or print 'engine'.

Images 1B, 2F, 3B, 4F, 5B, 6F, 7B, and 8F are reverse ordered in a first photoreceptor 11 and printed sequentially on one side of sheets 8 through 1, as shown in FIG. 1. The images and sheets can also be ordered 1 through 8, respectively depending upon preference. Sheets 8 through 1 are fed sequentially to the first photoreceptor 11 along a sheet path 10. Images 1B, 2F, 3B, 4F, 5B, 6F, 7B, and 8F are fused sequentially on respective sheets 1 through 8 by a first fuser 13.

Images 1F, 2B, 3F, 4B, 5F, 6B, 7F, and 8B are reverse ordered in a second photoreceptor 12 and printed sequentially on the other side of sheets 8 through 1 along paper path 10, as shown in FIG. 1. Images 1F, 2B, 3F, 4B, 5F, 6B, 7F, and 8B are fused sequentially on respective sheets 1 through 8 by a second fuser 14. In the same instance, images 1B, 2F, 3B, 4F, 5B, 6F, 7B, and 8F are fused sequentially on respective sheets 1 through 8 for a second time by the second fuser 14.

Figure 2:
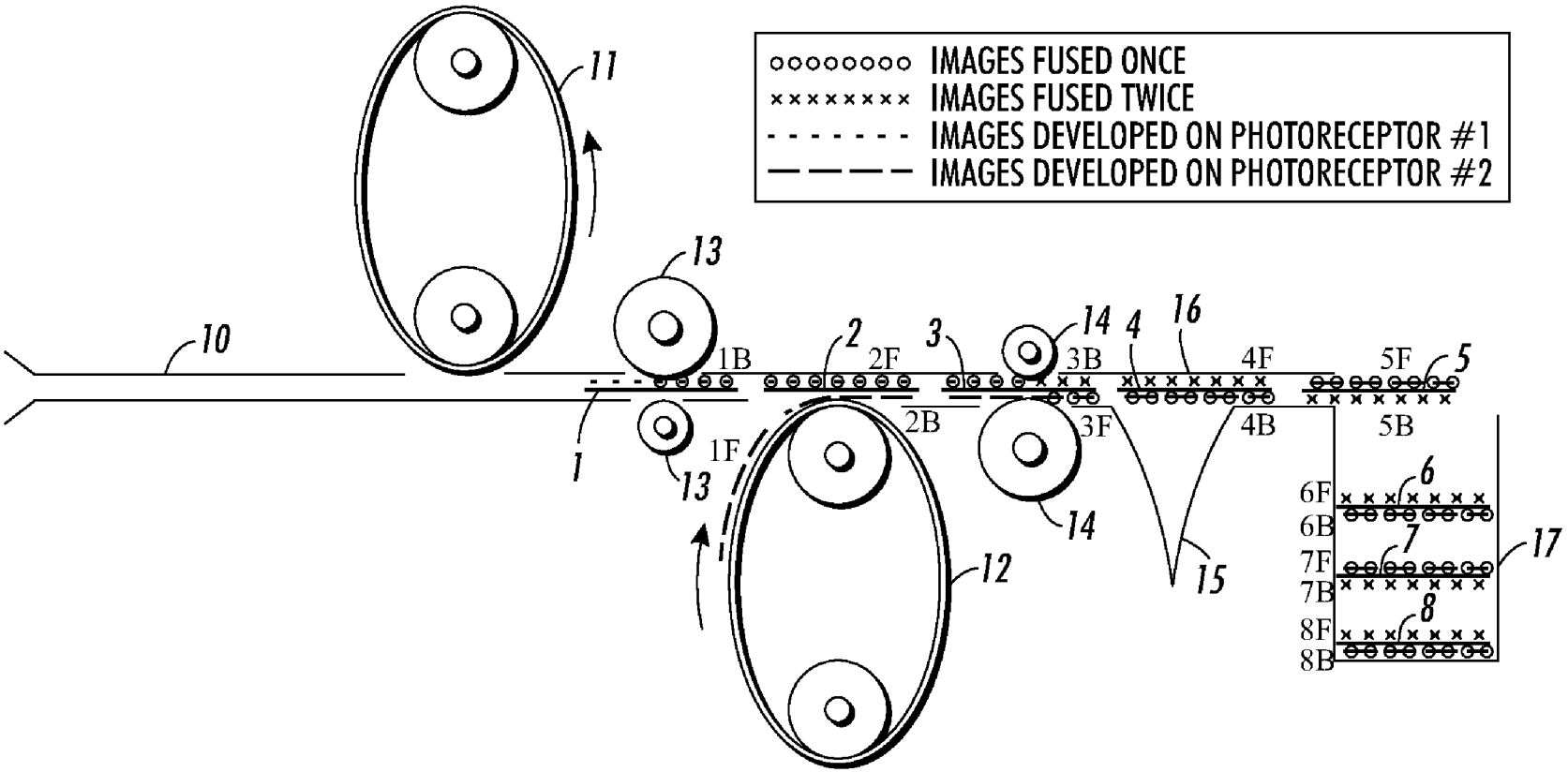
FIG. 2 is a schematic view of the paper path in the tandem duplex printer of FIG. 1 at a later moment.

Odd number sheets 1, 3, 5, and 7 are inverted by an inverter 15 prior to entering a stacker 17. Even number sheets 2, 4, 6, and 8 skip inverter 15 and enter stacker 17 through a bypass 16. The inverter 15/bypass 16 are located along paper path 10 between the second fuser 14 and the stacker 17. In this manner, images fused once are placed on pages that are destined as opposing pages of the finished booklet, such as 6B and 7F, and images fused twice are placed on pages that are destined as opposing pages of the booklet, such as 7B and 8F, as shown in FIG. 2, Moreover, images on opposing pages 6B and 7F are developed on the second photoreceptor 12, and images on opposing pages 7B and 8F are developed on the first photoreceptor 11, as shown in FIG. 2.

Figure 3:
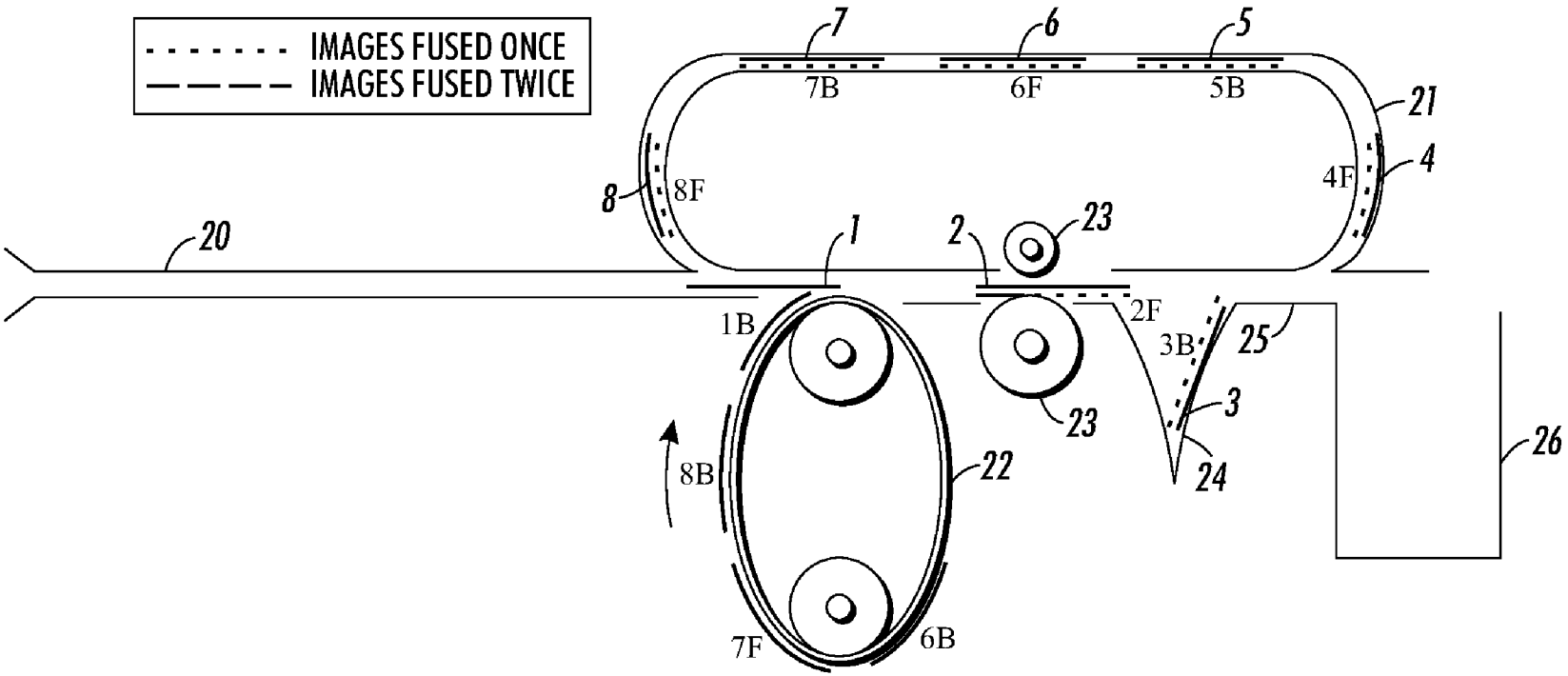
FIG. 3 is a schematic view of the paper path in a recirculating duplex printer in accordance with another embodiment.

In another embodiment, a schematic of the photoreceptor, fuser, paper path including inverter/bypass, and stacker of a recirculating duplex printer is shown in FIG. 3 for a 16 page (8 sheet) booklet job. Other types of recirculating duplex printers known in the art are suitable for use in accordance with the invention. Either a cut sheet or continuous web type can be utilized. The sheets are scheduled to provide a booklet having opposing pages fused the same number of times.

The print images are ordered so that opposing faces of pages in the finished booklet are fused the same number of times. A recirculating printer typically utilizes one photoreceptor or print "engine" so that the opposing faces of pages in the finished booklet are all printed by the same photoreceptor. Images 1B, 2F, 3B, 4F, 5B, 6F, 7B, and 8F are reverse ordered in a photoreceptor 22 and printed sequentially on one side of sheets 8 through 1, as shown in FIG. 3. The images and sheets can also be ordered 1 through 8, respectively depending upon preference. Sheets 8 through 1 are fed sequentially to the photoreceptor 22 along a sheet path 20. Images 1B, 2F, 3B, 4F, 5B, 6F, 7B, and 8F are fused sequentially on respective sheets 1 through 8 by the fuser 23.

Figure 4:
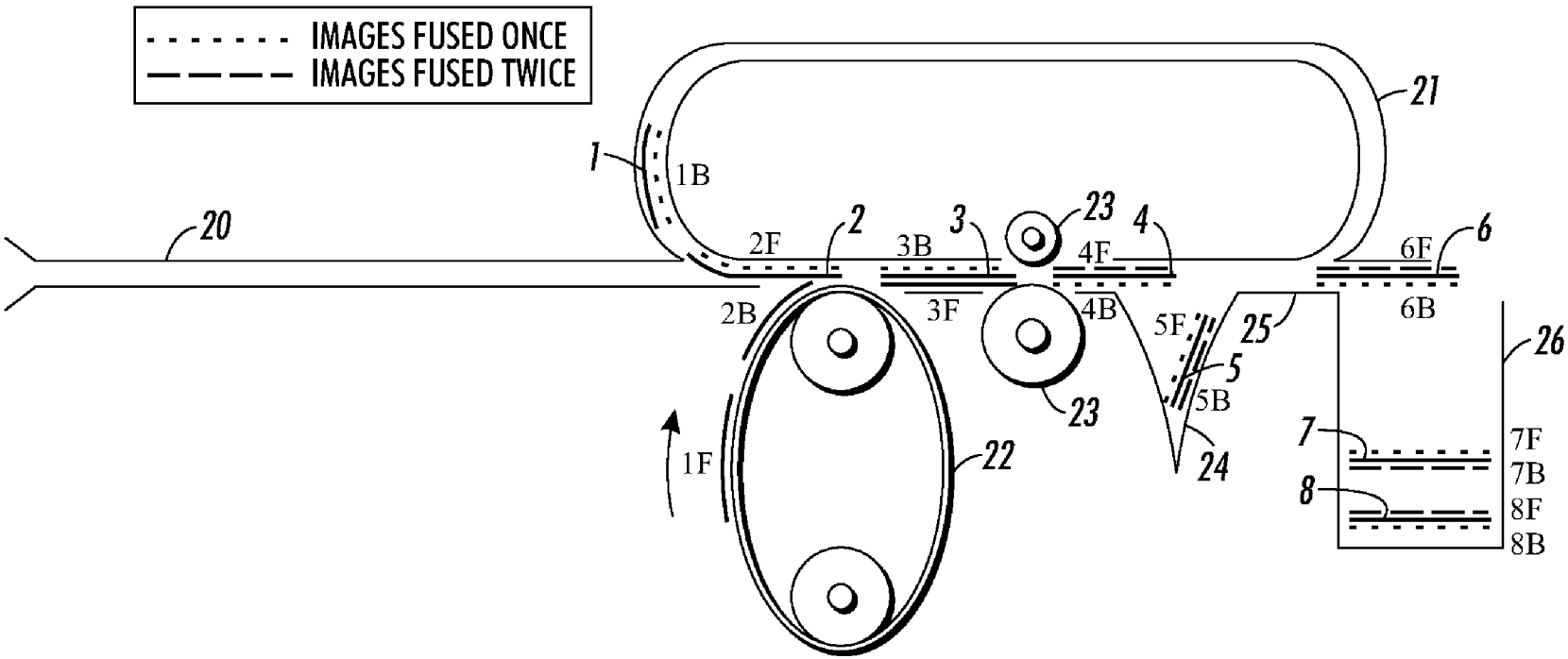
FIG. 4 is a schematic view of the paper path in the recirculating duplex printer of FIG. 3 at a later moment.

AH sheets 1 through 8 are inverted by an inverter 24 on their first pass prior to being recirculated through the printer 21. Images 1F, 2B, 3F, 4B, 5F, 6B, 7F, and 8B are reverse ordered in the photoreceptor 22 and printed sequentially on the other side of sheets 8 through 1 which are recirculating through printer 21, as shown in FIG. 4. Images 1F, 2B, 3F, 4B, 5F, 6B, 7F, and 8B are fused sequentially on respective sheets 1 through 8 by the fuser 23. In the same instance, images 1B, 2F, 3B, 4F, 5B, 6F, 7B, and 8F are fused sequentially on the other side of respective sheets 1 through 8 for a second time by the fuser 23.

As shown in FIG. 4, odd numbered sheets 1, 3, 5, and 7 are inverted by inverter 24 on their second pass prior to entering a stacker 26. Even number sheets 2, 4, 6, and 8 skip inverter 24 and enter stacker 26 through a bypass 25. The inverter 24/bypass 25 is located along paper path 10 between the fuser 23 and the stacker 26. In this manner, images fused once are placed on pages that are destined as opposing pages of the finished booklet, such as 6B and 7F, and images fused twice are placed on pages that are destined as opposing pages of the booklet, such as 7B and 8F, as shown in FIG. 4. Since the recirculating printer 21 utilizes one photoreceptor 22, the opposing faces of pages in the finished booklet are all printed by the same photoreceptor.

Suitable printer devices of the present invention include photoreceptors and direct marking printers, such as ink jet, solid ink jet, and thermal ink jet printers. When fixing an image to the sheet using a direct marking printer the method for producing a booklet from a multiple engine serial duplex printer, includes:

ordering sequentially a first plurality of images on a first printing device;

feeding sequentially a plurality of two-sided sheets to the first printing device;

printing sequentially on one side of each of the plurality of two-sided sheets a corresponding one of the first plurality of images;

ordering sequentially a second plurality of images on a second printing device, such that when the second plurality of images is sequentially printed on a corresponding one of the other side of each of the plurality of two-sided sheets and alternate sheets in the sequence are inverted and stacked with alternate non-inverted sheets, images on opposing sides of the sheets are printed by the same printing device;

feeding sequentially the plurality of two-sided sheets to the second printing device;

printing sequentially on the other side of each of the plurality of two-sided sheets a corresponding one of the second plurality of images;

inverting alternated ones of the plurality of two-sided imaged sheets; and stacking sequentially the inverted sheets and non-inverted sheets, so that images on opposing sides of the sheets are printed by the same printing device.

Other modifications of the present invention may occur to those skilled in the art subsequent to a review of the present application, and these modifications, including equivalents thereof, are intended to be included within the scope of the present invention.

What is claimed is:

1. A system for printing a booklet, comprising:

a feeder for sequentially feeding a number of two-sided print media to a photoreceptor using a first print media path, the photoreceptor being adapted for providing an image on each of the number of print media including a first side and a second side;

a fuser for fixing a first plurality of images on one side of the number of print media in a first pass through the first print media path;

an inverter for inverting an orientation each of the number of print media at conclusion of the first pass through the first print media path;

a second recirculation path for returning the number of print media to the first print media path;

the fuser fixing a second plurality of images on an opposite side of the number of print media in a second pass through the first print media path;

a bypass adapted to provide the inverter with alternate ones of the number of print media at conclusion of the second pass through the first print media path, the inverter adapted to invert an orientation of the alternate ones of the number of print media; and, a stacker for stacking the number of print media.

2. The system of claim 1, wherein the feeder sequentially feeds the number of print media in reverse order.

3. The system of claim 1, wherein the fuser fuses images on a first side of the odd numbered print media and on a second side of the even numbered print media in the first pass.

4. The system of claim 3, wherein the fuser fuses images on a second side of the odd numbered print media and on a first side of the even numbered print media in the second pass.

5. The system of claim 1, wherein the inverter is situated after the fuser and before the stacker.

6. The system of claim 5, wherein the inverter is situated before the second recirculation path.

7. The system of claim 1, wherein said system is a recirculating duplex printer.

8. A system for producing a booklet, comprising:

a sorting component that sequentially orders a first plurality of images and a second plurality of images;

a feeder that sequentially feeds a plurality of two-sided print media;

a printer that sequentially transfers one of the first plurality of images on a first side of each of the plurality of two-sided print media;

a fixer that fixes the transferred images on each print media; and, an inverter that sequentially inverts a first pass of each one of the imaged plurality of two-sided print media;

a bypass that provides the inverter with alternate ones of the print media at conclusion of a second pass;

wherein the printer subsequently sequentially transfers one of the second plurality of images on a second side of each of the plurality of two-sided print media, the fixer fixes the transferred images and the inverter inverts the alternate print media at the conclusion of the second pass of the plurality of two-sided printed media, and the plurality of two-sided print media are arranged to facilitate creating an associated booklet in which a plurality of print media forming the booklet each have an image contained thereon and each print media has been subject to fixing a same number of times as the image on an opposing print media.

9. The system of claim 8, wherein the fixer fixes the transferred images on each print media via a fusing technique.

10. The system of claim 8, wherein the printer includes a photoreceptor.

11. The system of claim 8, wherein the printer is a recirculating duplex printer.

12. The system of claim 8, further comprising a stacker that stacks inverted print media and non-inverted print media from the second pass of the plurality of two-sided printed print media to facilitate positioning of the print media subject to the fixing process the same number of times on opposing print media in the associated booklet.

* * * * *